US006196570B1

(12) United States Patent
Klubitschko

(10) Patent No.: US 6,196,570 B1
(45) Date of Patent: Mar. 6, 2001

(54) BOOT-RETAINING UNIT OF A DISENGAGEABLE SKI BINDING

(75) Inventor: Gerd Klubitschko, Oberammergau (DE)

(73) Assignee: Marker Deutschland GmbH, Eschenlohe (DE)

( * ) Notice: Subject to any disclaimer, the term of this patent is extended or adjusted under 35 U.S.C. 154(b) by 0 days.

(21) Appl. No.: 08/923,847

(22) Filed: Sep. 4, 1997

(30) Foreign Application Priority Data

Sep. 11, 1996 (DE) ..... 196 36 885
Jan. 17, 1997 (DE) ..... 297 00 630 U

(51) Int. Cl.[7] ..... A63C 9/10
(52) U.S. Cl. ..... 280/625; 280/628
(58) Field of Search ..... 280/619, 620, 280/615, 631, 625, 623, 626, 628, 636, 618, 624, 629

(56) References Cited

U.S. PATENT DOCUMENTS 3,909,030 * 9/1975 Beyl ..... 280/630
4,298,213 * 11/1981 Storandt ..... 280/628
4,903,979 * 2/1990 Dimier ..... 280/628
4,974,869 12/1990 Muhlberger et al. .
5,205,576 * 4/1993 Bogner et al. ..... 280/629

FOREIGN PATENT DOCUMENTS 673 403 A5 3/1990 (CH) .
26 29 452A1 1/1978 (DE) ..... A63C/9/085
34 03 472A1 8/1985 (DE) ..... A63C/9/085
38 21 097A1 3/1989 (DE) ..... A63C/9/085
38 25 682A1 2/1990 (DE) ..... A63C/9/085
42 03 569A1 8/1993 (DE) ..... A63C/9/085
0 385 946 2/1990 (EP) .

* cited by examiner

*Primary Examiner*—Paul N. Dickson
*Assistant Examiner*—Faye M. Fleming
(74) *Attorney, Agent, or Firm*—D. Peter Hochberg; William H. Holt

(57) ABSTRACT

That end of a ski boot which is retained by the boot-retaining unit is retained such that it can be disengaged in the sideways direction and vertical direction. Upon sideways movement of the ski boot within a range of elasticity of the boot-retaining unit, the ski boot is rendered capable of moving increasingly in the upward direction, strong forces in the upward direction producing a force component which additionally forces the boot-retaining unit in the sideways direction.

17 Claims, 5 Drawing Sheets

BOOT-RETAINING UNIT OF A DISENGAGEABLE SKI BINDING

BACKGROUND OF THE INVENTION

1. Field of the Invention

The invention relates to a boot-retaining unit of a disengageable ski binding, in particular for retaining the toe region of a ski boot, having at least one boot-retaining arrangement which supports an end of the ski boot, or an end of the sole of the latter, against movement upwards, sideways and in a longitudinal direction of the boot, and which is arranged such that it can be moved counter to a restoring force to release the boot, or the sole thereof, in the sideways and upward directions when a range of elasticity is exceeded.

2. Description of the Prior Art

Ski bindings which allow the ski boot to be released in various directions under the action of corresponding disruptive forces are generally known. Account is thus taken of the fact that a skier can have very different types of falls, and that, for example, a boot-retaining unit which retains the front end of the ski boot should therefore be disengageable both in the sideways direction and in the upward direction.

A basic difficulty with such bindings arises in conjunction with so-called combined falls, in which the binding is stressed, for example, relative to the upper side of the ski, in the upward and sideways directions. Account should be taken here that, in the case of a combined fall, the energy, which is needed for moving the ski boot until a disengagement position is reached, should only rise to a limited extent in comparison with a straightforward fall, in which the binding in the outlined example is only forced either in the sideways direction or in the upward direction. This is based on the fact that the overall stressing to which the bones and joints of the skier can be subjected is limited. In any case, it is extremely dangerous if limited stressing in one direction, which is itself still tolerable, occurs at the same time as a high degree of stressing in another direction which is tolerable on its own.

In this context, it is known from German Offenlegungsschrift 38 21 097 to arrange a boot-retaining means, in the case of a binding of the type specified in the introduction, such that, in the case of increasing sideways movement, it executes an increasing tilting movement around a transverse axis of the ski and thus, in the case of sufficient sideways movement, also releases the boot in the upward direction.

French A 2 628 647 discloses a binding in which boot-retaining elements which secure the boot against movements in the upward direction and boot-retaining elements for securing the ski boot against sideways movement interact with a common disengagement spring mechanism such that the energy which is necessary for disengagement remains sufficiently limited even in the case of combined falls. However, the case may arise where, in unfavorable conditions, disengagement is possible with a comparatively very small amount of disengagement work.

German Offenlegungsschrift 26 29 452 discloses a boot-retaining unit having two spring units, of which one is provided for controlling disengagement of the ski boot in the direction of the transverse axis of the boot and one is provided for controlling disengagement of the ski boot in the direction of the vertical axis of the boot. Each spring unit interacts with a separate boot-retaining means, and each retaining means can retain the boot only in the disengagement direction assigned to the respective spring unit. In this case, in the event of a combined fall, the legs and joints of the skier may be subjected to a very high degree of stressing because, in unfavorable conditions, disengagement of the ski boot only takes place when both the work which is necessary purely for sideways disengagement and the work which is necessary purely for vertical disengagement have been produced.

SUMMARY OF THE INVENTION

The object of the invention, then, is to achieve particularly easily reproducible operational behavior in a boot-retaining unit of the type specified in the introduction.

This object is achieved according to the invention in that, upon movement in the transverse direction of the boot or ski, the boot-retaining arrangement executes an increasing upward movement and/or is rendered capable of an increasing upward movement, relative to an abutment, which counteracts an upward movement of the boot-retaining arrangement and is arranged in a relatively immovable manner in the transverse direction of the boot or ski.

The invention is based on the general idea of keeping the disengagement action which is necessary in the case of combined falls limited, in that, on the one hand, disengagement action which is necessary for vertical disengagement is reduced as the sideways displacement of the boot-retaining arrangement increases and, on the other hand, forces which act on the boot-retaining arrangement in the upward direction produce a force which assists sideways disengagement as soon as the boot-retaining arrangement has been displaced by a predetermined amount out of its normal position in the sideways direction.

This additional force results from the increasing upward movement, or capability of increasing upward movement, of the boot-retaining arrangement, this movement occurring in the case of a sideways movement of the boot-retaining arrangement, with respect to the abutment, which counteracts the upward movement. At the same time, this upward movement, or capability of upward movement, in the case of a sideways movement of the boot-retaining arrangement has the effect of reducing the energy which is necessary for vertical disengagement.

According to a preferred embodiment of the invention, the boot-retaining arrangement, or a part of the same, and the abutment interact via pressure-transmitting surfaces, which limit or prevent movement of the boot-retaining arrangement, or of a part of the same, and, on account of their shape, provide the boot-retaining arrangement, or the boot-retaining part, with the capability of moving increasingly in the upward direction in the case of sideways displacement.

The abutment may be provided with a spring mechanism, which permits an upward movement of the abutment counter to a predetermined or adjustable force.

A spring mechanism which is separate from the spring mechanism of the abutment preferably counteracts a sideways movement of the boot-retaining arrangement.

According to a particularly preferred embodiment of the invention, the abutment is designed as a double-arm lever which can be pivoted around a transverse axis and on whose one arm the boot-retaining arrangement, or a boot-retaining part, is supported against upward movement and whose other arm is designed and/or supported in a resiliently compliant manner, it being possible to adjust the resilient compliance of the abutment by adjusting the support and/or changing the effective length of the lever arm.

According to an expedient configuration of the invention, it may be provided that the capability of the boot-retaining arrangement, or of the boot-retaining part, to move vertically on both sides of the normal position increases to a slight extent first of all and to a pronounced extent in the case of further sideways displacement. In this manner, it is possible to achieve the situation where, in the case of a small amount of sideways displacement, all that takes place initially is a compensation of the friction which occurs between the boot-retaining arrangement, or the boot-retaining part, and the abutment when forces act on the boot-retaining arrangement, or the boot-retaining part, in the upward direction. It is only in the case of further displacement of the bootretaining arrangement, or of the boot-retaining part, that said upward forces also effect a sideways force which acts in the direction of the respective sideways displacement.

BRIEF DESCRIPTION OF THE DRAWINGS

Moreover, as regards preferred features of the invention, you are referred to the claims and to the following explanation of the drawing, with reference to which a particularly preferred embodiment of the invention is described and in which:

DESCRIPTION OF THE PREFERRED EMBODIMENT

Figure 1:
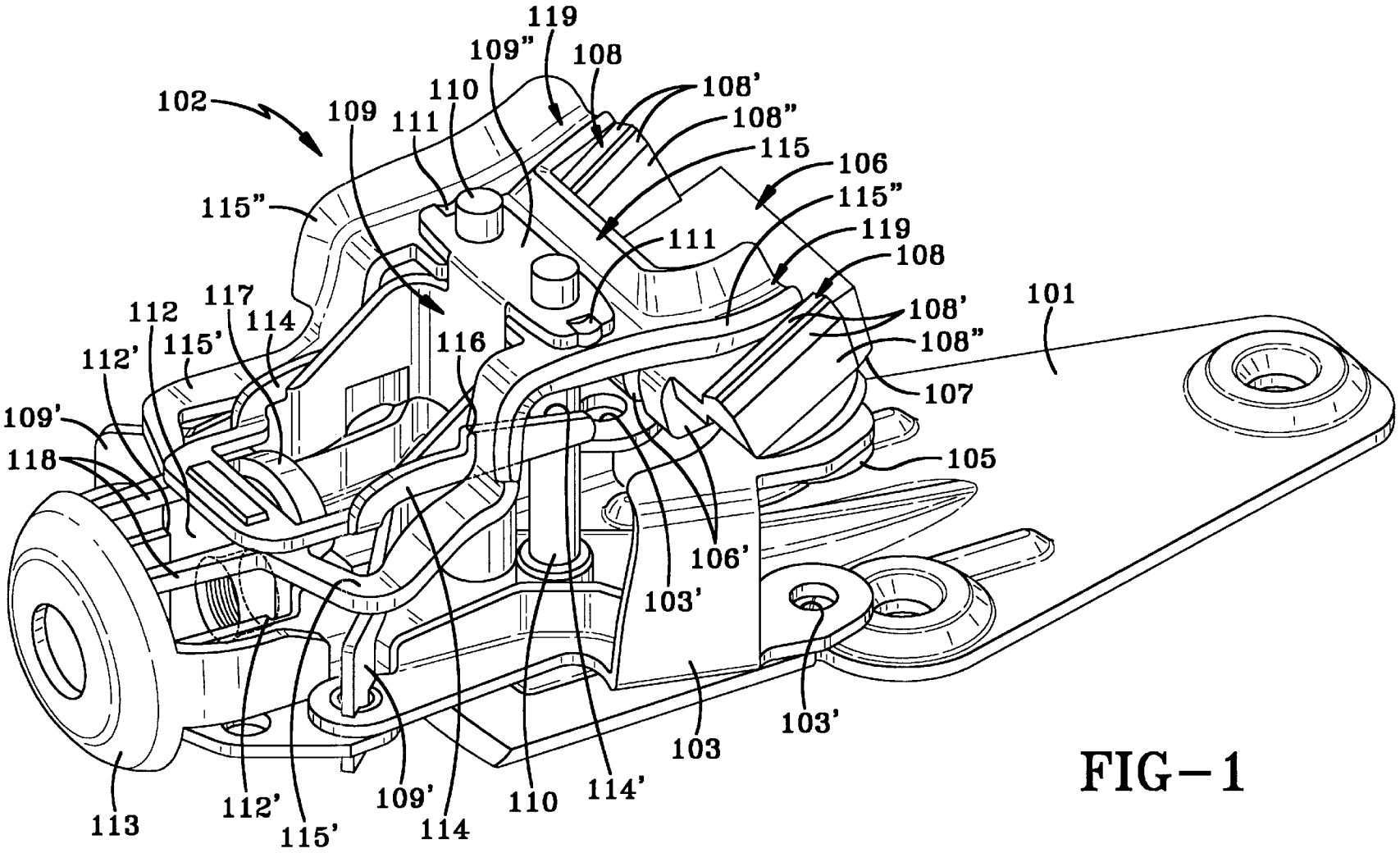
FIG. 1 shows a perspective view of an inventive boot-retaining unit for retaining the front end of the sole of a ski boot.
Figure 2:
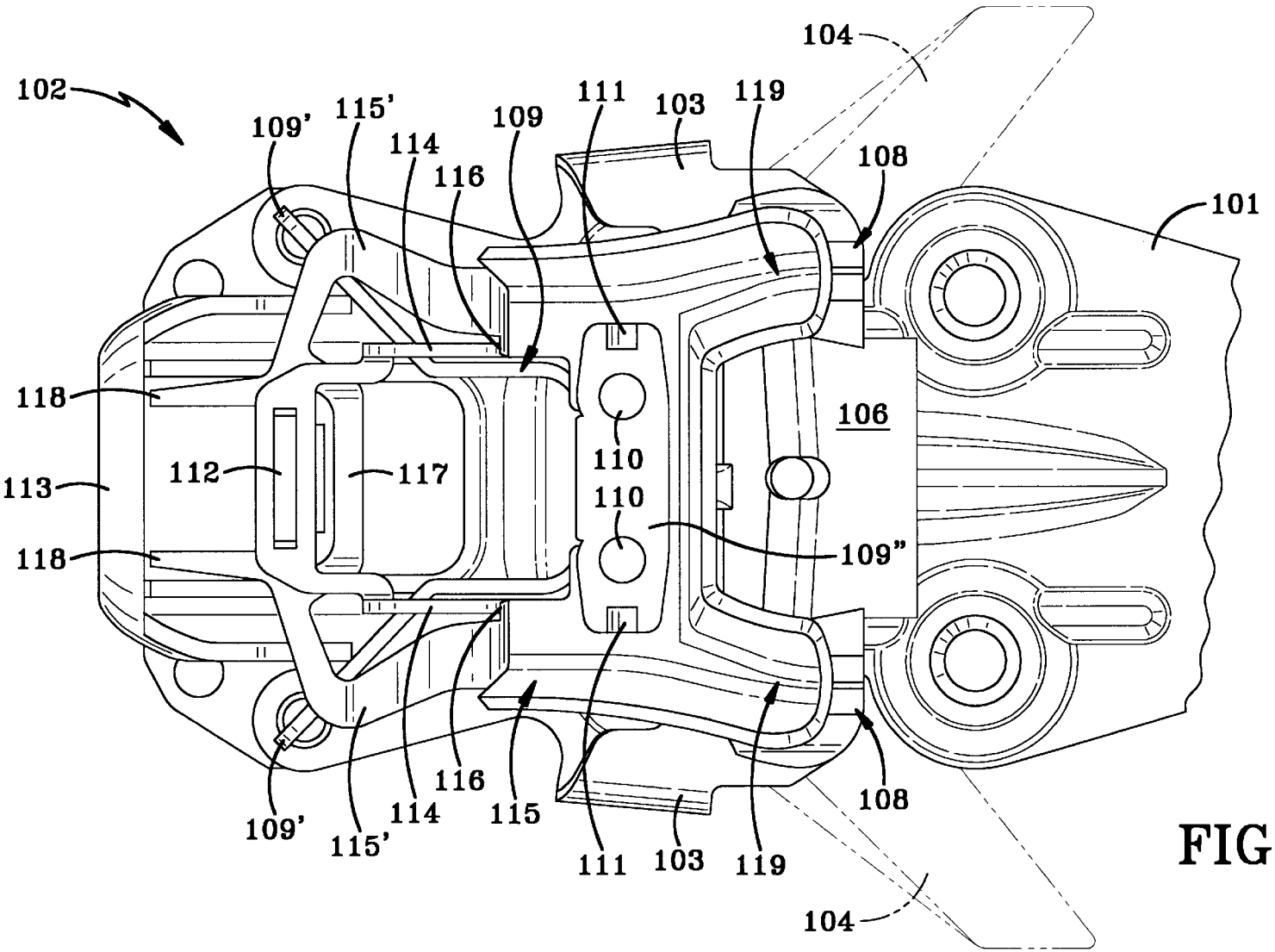
FIG. 2 shows a plan view of the boot-retaining unit.
Figure 3:
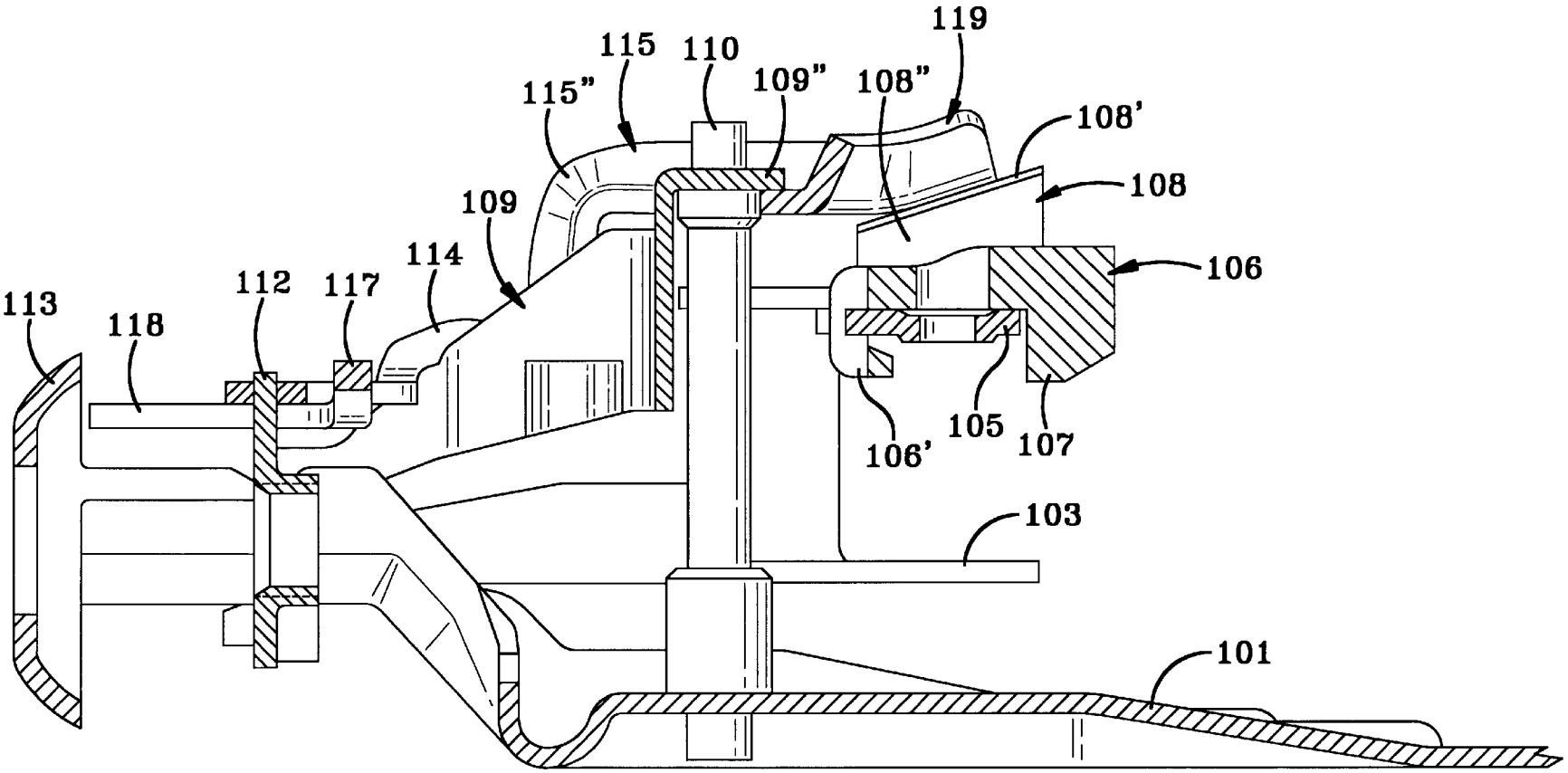
FIG. 3 shows a vertical longitudinal section through the center.

According to FIG. 1, a base plate 101, which is fixedly arranged on the upper side of a ski (not illustrated), bears a skeleton-like housing structure 102, which is fixedly connected to said base plate. Two guide links 103 are mounted, such that they can be pivoted around vertical axes, in the front region of said housing structure, on both sides of a vertical center longitudinal plane, and there is bearing play ensuring that the guide links 103 can also be pivoted to some extent around a transverse axis passing through their bearing parts on the housing. At their ends which are at the rear in FIG. 1, the guide links 103 have in each case two articulation eyelets 103' which are located approximately vertically one above the other and serve for mounting sole-retaining parts 104, which are only indicated in FIG. 2 and, in their normal position, engage laterally around the front end of the sole and thus secure this in the transverse direction. In addition, the guide links 103 are connected to one another in an articulated manner, via a flat band 105, at their top articulation eyelets 103', with the result that they always pivot together in the transverse direction. In the example of FIG. 1, the guide links 103 are deflected in the direction of the viewer.

Arranged on the flat band 105 is a sole-retaining part 106 which engages over the front border of the sole from above and engages over the front transverse border of the flat band 105 by hook-like extensions 106', by means of which the sole-retaining part 106 is secured such that it can be pivoted upwards around the front edge of the flat band 105.

The rear transverse border of the sole-retaining part 106 is designed as a downwardly directed strip 107 which, in the normal position of the sole-retaining part 106, projects downwards beyond the underside of the flat band 105 and rests on the border of the front end of the sole of the ski boot from above.

Formed on the upper side of the sole-retaining part 106 are two strip-like prism bodies 108 which are aligned somewhat obliquely with respect to the longitudinal axis of the ski or of the boot-retaining unit, such that the longitudinal directions of the prism bodies 108 form an angle which opens slightly towards the rear end of the ski.

In addition, the spine of the prism bodies 108 slopes upwards towards the rear in the longitudinal direction of the ski.

Figure 4:
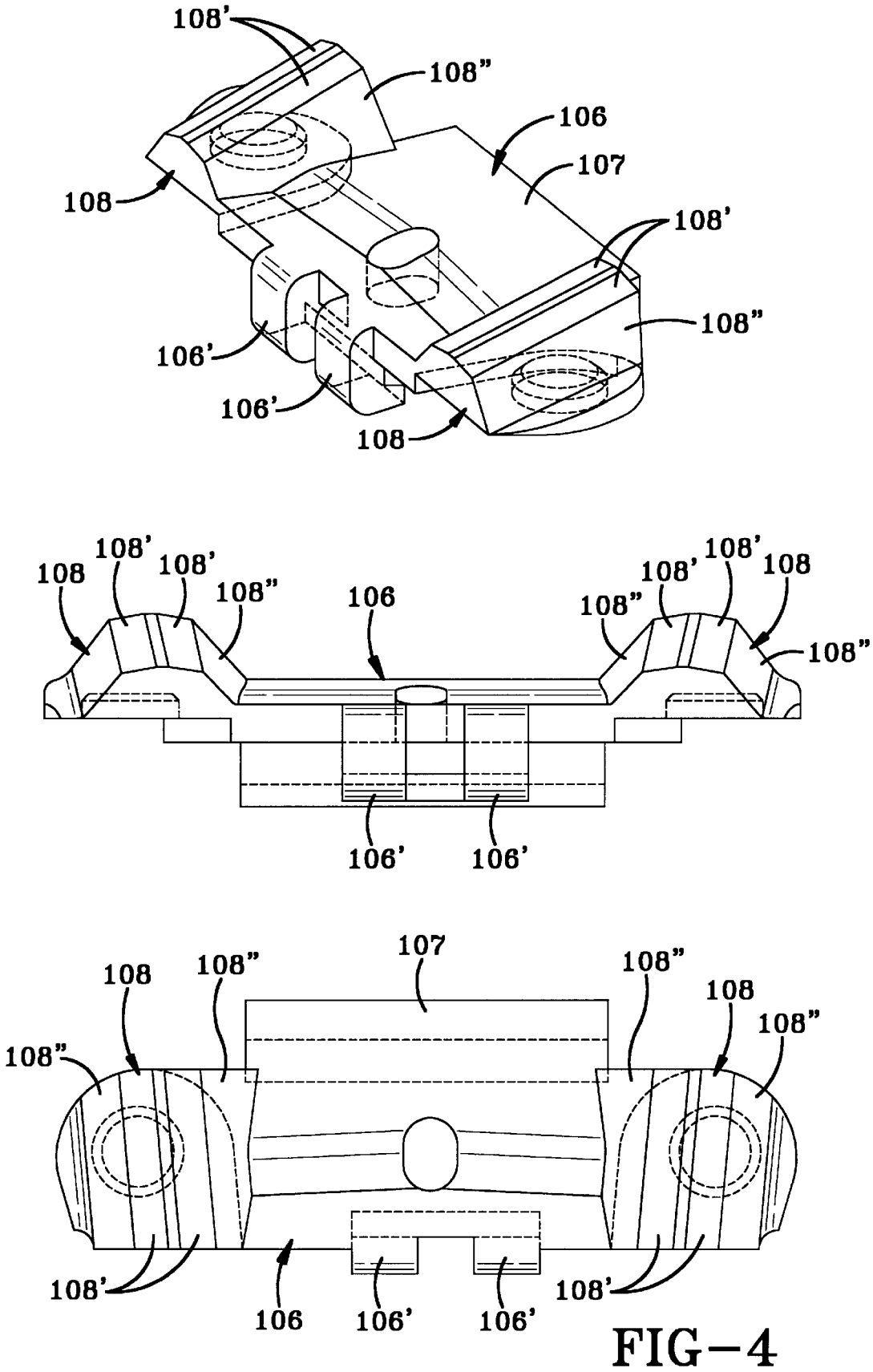
FIG. 4 shows various views, to be precise a perspective view, a front view and a plan view, of a boot-retaining part which secures the ski-boot sole against upward movement.

As can be seen, in particular, from FIG. 4, the spines of the prism bodies 108 each have a narrow central strip which is not inclined sideways, and then, adjoining on both sides, have oblique surfaces 108' with a slight sideways gradient of, for example, 8° with respect to the horizontal and then have adjoining flanks 108" with a steep gradient of, for example, 50° with respect to the horizontal. The surface of the spines of prism bodies 108 are adapted to transmit and accept pressure as a result of upward movement of the sole.

The housing structure 102 has a stiffening part 109 which is arranged between the guide links 103 and is retained by feet 109', which serve as pivot axes for the guide links 103, on a housing underside and is retained on two stable housing columns 110 by an essentially horizontal top part 109". Formed laterally outside the columns 110, on the top part 109", are two beads 111 with the convex side oriented downwards.

In a front section, the housing structure 102 forms a longitudinal guide for a spring abutment 112 which, in a manner which is known in principle, can be displaced and adjusted in the longitudinal direction by means of an adjustment screw (not illustrated) which is retained by a receiving part 113. This spring abutment 112 supports a helical compression spring (not illustrated) which is arranged in the longitudinal direction and controls a latching arrangement, which is known in principle and by means of which the guide links 103 are retained in a central position so as to be disengageable in the sideways direction. Arranged on the spring abutment 112 are two fork-like extensions 114 which are oriented rearwards in the longitudinal direction of the ski, are supported in the vertically downward direction on protrusions on the stiffening part 109 and have top borders 114'which slope downwards in a ramp-like manner in the rearward direction.

A spring part 115 is fixedly retained on the columns 110 in the longitudinal and transverse directions of the boot-retaining unit. In plan view, this spring part has an H-shape in the region of the columns and of the top part 109, of the stiffening part 109, the crossbar of the H being arranged behind the top part 109", as seen in the longitudinal direction. The rearwardly facing ends of the side parts of the H interact, in a manner outlined below, with the prism bodies 108 of the sole-retaining part 106. In front of the top part 109" of the stiffening part 109, the side parts of the H are angled vertically downwards, the downwardly angled parts being provided with shoulders 116 which interact, in a manner outlined below, with the top borders 114' of the extensions 114.

Beneath the shoulders 116, the side parts of the H are designed, in the manner of a spring tongue, with spring brackets 115' which extend in the forward direction and are connected to one another between the extensions 114 by a transverse bracket 117. Connected in front of this are extensions 118 which are aligned in the longitudinal direction and are supported on the spring abutment 112 between the extensions 114 and shoulders 112 ' without obstructing the adjustment capability of the spring abutment 112.

The spring brackets 115' between the shoulders 116 and the transverse bracket 117 are leaf-spring-like, while those regions of the spring part 115 which adjoin in the upward and rearward directions are comparatively stiff since, here, the side parts of the spring part 115 have laterally upwardly bent borders 115" and, accordingly, a channel profile.

The rearwardly oriented ends of the spring part 115 form prism bodies 119 similar to the prism bodies 108 of the sole-retaining part 106, a narrow central face which is arranged, without inclination, in the transverse direction being adjoined by oblique surfaces which are inclined upwards to a slight extent and then by flanks which are inclined steeply upwards. The central face, the oblique surfaces and the flanks of prism bodies 119 are adapted to transmit and accept pressure due to interaction with the surfaces of the spines of prism bodies 108 when subjected to pressure forces as a result of upward movement of the boot sole. In this arrangement, the outer flanks merge into the borders 115"; the inner flanks are connected rigidly to one another via an upwardly bent border of the transverse web of the spring part 115 beside the top part 109".

The arrangement illustrated functions as follows:

In the normal position, i.e. when the ski boot and its sole are fixed properly in the boot-retaining unit, the guide links 103 and the sole-retaining part 106 assume their central position, in which the sole-retaining parts 104 engage around the lateral sole borders and the sole-retaining means 106 engages, by its strip 107, over the front border of the sole from above. In this arrangement, the prism bodies 108 of the sole-retaining part 106 are located on the prism bodies 119, to be precise such that the narrow central regions of the prism bodies, i.e. their "roof ridges," are located one upon the other.

If, then, an excessive sideways force is exerted on the boot, the boot sole presses against one of the lateral sole-retaining parts 104, with the result that the guide links 103 are deflected counter to the restoring force produced by the disengagement spring mechanism. With sufficient deflection, the sole-retaining part 104 which is located at the front, as seen in the movement direction in each case, pivots outwards and releases the boot. In this respect, the boot-retaining unit according to the invention functions in the conventional manner.

As soon as the boot is subjected to a force which forces the toe of the boot in the upward direction, the sole-retaining part 106 is forced in the upward direction against the prism bodies 119, in which case the sole-retaining part 106 tries to pivot (in the anticlockwise direction in FIG. 1) around the front transverse border of the flat band 105, said border being gripped by the hook-like extensions 106' of the sole-retaining part 106. With sufficient upward force, the prism bodies 119 of the spring part 115 can be bent upwards such that the sole-retaining part 106 releases that border of the sole which it overlaps, and thus releases the sole of the boot and the boot itself, in the upward direction. In this case, on the one hand, the spring force of the spring brackets 115' has to be overcome. In addition, the spring part 115 is supported on the top borders 114' of the extensions 114 sooner or later by its shoulders 116, with the result that that region of the spring part 115 which is stiffened by the borders 115" is also bent elastically to a more or less pronounced extent.

The forces which are to be overcome here are determined by the position of the spring abutment 112 and of the extensions 114 which are connected thereto. If the spring abutment 112 in FIG. 1 is displaced far to the right with the extensions 114, the prism bodies 119 form a particularly stiff abutment for the prism bodies 108 of the sole-retaining part 106. If, in contrast, the spring abutment 112 in FIG. 1 is displaced to the left together with the extensions 114, the prism bodies 119 are retained in a comparatively compliant manner.

Since the restoring forces which try to keep the guide links 103 in their normal position are also changed correspondingly with the displacement of spring abutment 112, the stiffness with which the prism bodies 119 are retained is thus changed in the same manner as the restoring force which acts on the guide links 103.

The sole-retaining part 106 may be designed such that, under forces which try to lift the boot, the front border of the boot sole butts against the strip 107 and tries to pivot the sole-retaining part 106 upwards around the front edge of the flat band 105, the hook-like extensions 106'engaging around said front edge. Since the strip 107 is spaced apart from said front edge, i.e. the pivot axis of the sole-retaining part 106, by a greater distance than the zones of contact between the prism bodies 108 of the sole-retaining part 106 and the prism bodies 119 of the spring part 115, the latter prism bodies 119 are pushed upwards by a force which is larger than the forces acting between the sole and the strip 107, the spring part 115 being bent correspondingly in the process. At the same time, the flat band 105, with the binding parts connected thereto, is pushed downwards. An appropriate selection of the distance between the front edge of the flat band 105 and the strip 107 or the abutment region of the boot sole, on the one hand, and the distance between said front edge and the zones of contact of the prism bodies 108 and 119, on the other hand, makes it possible to achieve different active lever lengths, with the result that an upwardly directed force exerted by the boot is transferred to the spring part 115 to different extents. This can also influence the disengagement behavior of the binding in the case of upwardly directed forces.

Figure 5A:
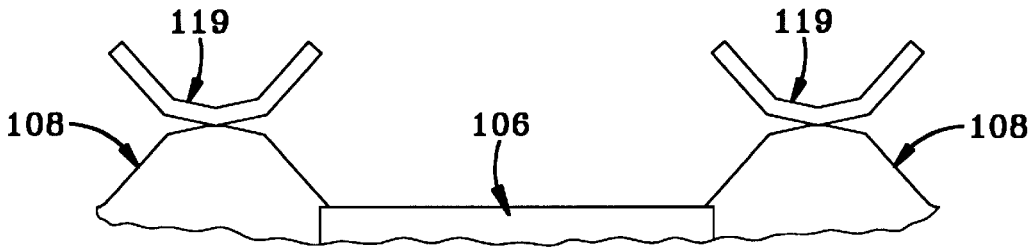
FIG. 5(A) is a rear view of a component of the invention without any sideways forces on the boot retaining unit.
Figure 5B:
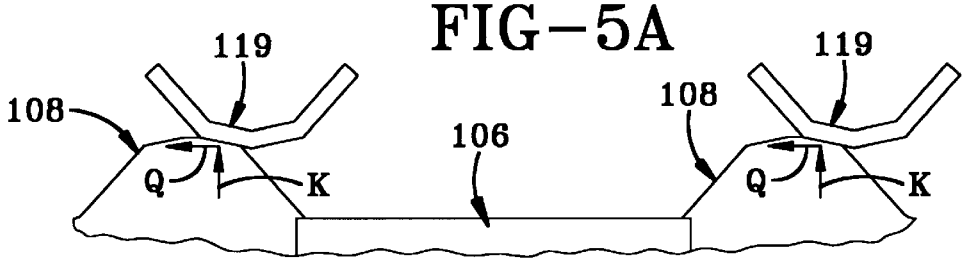
FIG. 5(B) is a rear view of the component shown in FIG. 5(A) with sideways forces on the boot retaining unit.

Now, let us assume that the boot is subjected to a force with a sideways component and an upward component. If this force is sufficiently large, the guide links 103 will pivot some way to the side, with the result that the prism bodies 108 of the sole-retaining part 106 and the prism bodies 119 of the spring part 115 pass out of the position illustrated in FIG. 5(*a*), in which the "roof ridges" of the prism bodies 108 and 119 are located one upon the other, into the position of FIG. 5(B), in which the prism bodies 108 and 119 are located somewhat eccentrically one upon the other, i.e. their slightly inclined oblique surfaces to the sides of their central strip or of their roof ridges interact with one another. On account of the upwardly directed force K which acts on the sole-retaining part 106, the oblique surfaces are correspondingly pressed against one another, in which case the inclination of these oblique surfaces produces a certain force component Q in the sideways direction, in which the guide links 103 have already been deflected to some extent. This sideways component Q largely compensates for the friction between the prism bodies 108 and 119.

Figure 5C:
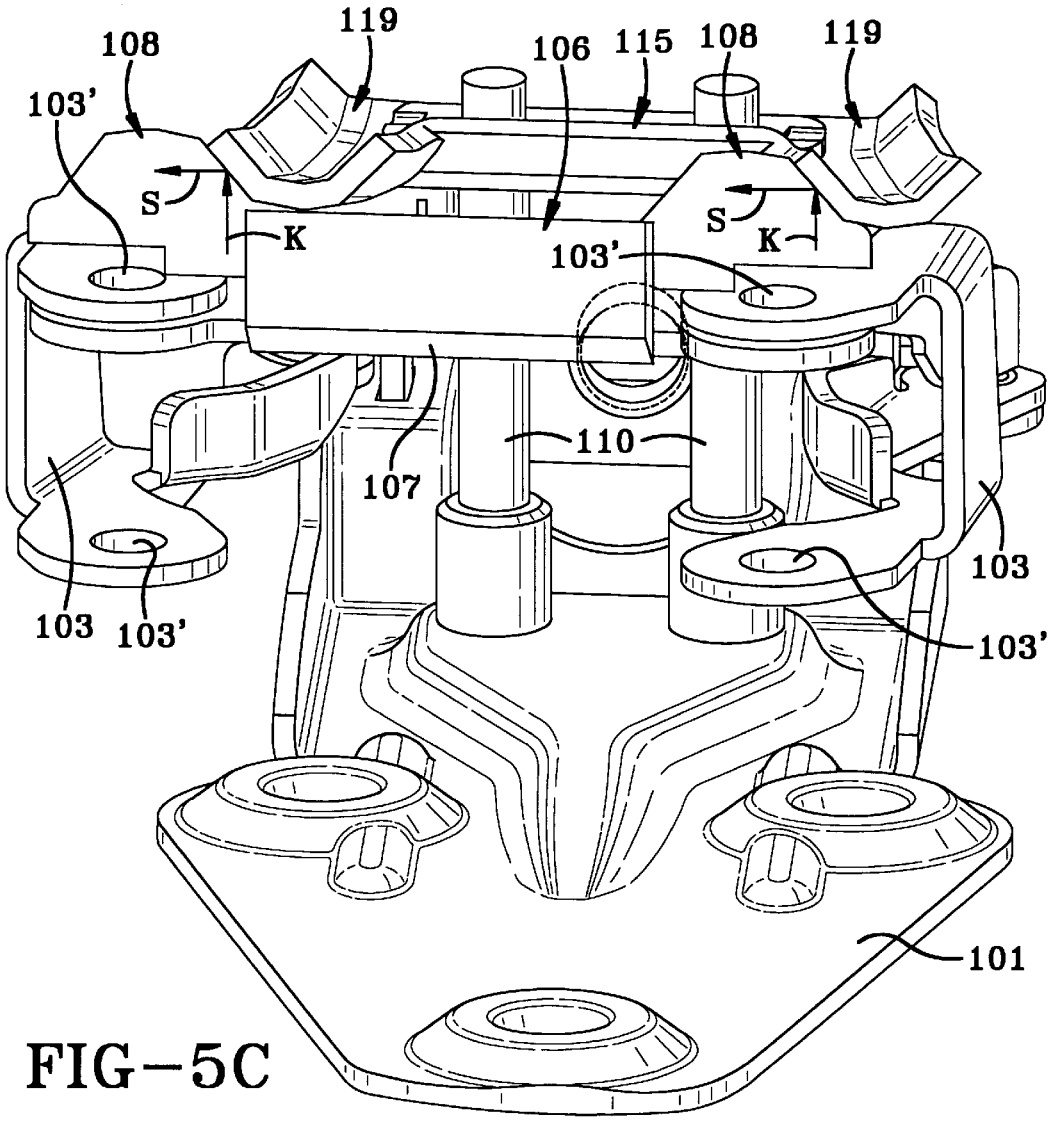
FIG. 5(C) is a perspective rear view of the boot-retaining unit.

If sufficient force continues to act on the boot in the sideways direction, the steep flanks of the prism bodies 108 and 119 come into contact with one another, in accordance with FIG. 5(C), with the result that a considerable sideways force S is produced of the sole-retaining part 106, which continues to be forced upwards on account of upwardly directed forces K.

This results in the guide links 103 being pivoted further to the side even in the case of exclusively upwardly directed external forces, in which case the boot-retaining unit 102 releases the boot in the sideways direction by unlocking one of the sole-retaining parts 104 and/or also in the upward direction as a result of increasing upward movement or as a result of increasing upward pivoting of the sole-retaining parts 104 or of the sole-retaining part 106.

As a result, in the case of increasing sideways movement, the sole-retaining part 106 is thus rendered capable of moving increasingly in the upward direction and, finally, can release the boot in the upward direction. Furthermore, a force which forces the sole-retaining part 106 upwards assists, by interaction of the flanks of the prism bodies 108 and 119 with one another, increasing sideways pivoting of the guide links 103 since the upwardly directed force produces a sideways force which acts on the guide links and counteracts the binding disengagement resistance which counteracts sideways disengagement of the binding, with the result that, ultimately, with a continuing upward force, the boot or the sole is released more easily and earlier in the sideways direction.

FIG. 1 shows the sole-retaining means 106 in a position in which the prism bodies 108 have been displaced in the direction of the viewer relative to the prism bodies 119 and the sole-retaining means 106, together with those ends of the guide links 103 which retain it, and with the flat band 105, have reached an upwardly raised position.

Unlike the embodiments described above and illustrated in the drawing, it may be provided that the sole-retaining parts 104 (see FIG. 2) secure the boot not only in the sideways direction but also in the upward direction, and for this purpose, also engage over the borders of the front region of the sole of the ski boot from above.

In the case of an embodiment of this type, the strip 107 on the sole-retaining part 106 is superfluous, so that the part 106 may serve merely as a support for the prism bodies 108.

Those surfaces of the sole-retaining parts 104 and/or of the sole-retaining part 106, and/or of the strip 107 thereof, which engage over the border of the sole of the ski boot from above may be designed as oblique surfaces which slope upwards towards the boot. If a pronounced upward force acts on the boot, for example when the skier falls backwards, the oblique surfaces also force the boot in the rearward direction against a further boot-retaining unit, which retains the heel of the ski boot and can be moved in the conventional manner in the longitudinal direction of the ski counter to a push-action spring mechanism, which normally serves for avoiding excessive clamping of the ski boot in the longitudinal direction in the case of bending movements of the ski and for retaining the boot between the boot-retaining units without play. With sufficiently large upward forces, the forces which force the ski boot in the rearward direction then suffice to push the ski boot, together with the heel-side boot-retaining unit, some way backwards counter to the push-action spring mechanism, with the result that the ski boot can be released in the upward direction from the front boot-retaining unit.

This can be facilitated further in that the upward forces which act on the ski boot also result in a more or less pronounced upward movement of the sole-retaining parts 104 and 106 if the spring part 115 yields in the upward direction to some extent and/or if, in the case of a simultaneous sideways movement of the sole-retaining parts 104 and 106, the prism bodies 108 are displaced sideways relative to the prism bodies 119 and are thus rendered capable of additional movement in the upward direction. Said upward movement of the sole-retaining parts 104 and 106 increases the steepness of the above-mentioned oblique surfaces on these parts, with the result that the boot is released more easily in the upward direction from the boot-retaining unit 102, the heel-side boot-retaining unit only needing to execute a comparatively small movement in the longitudinal direction of the ski counter to the push-action spring mechanism.

It is also possible for the prism bodies 108 to be assigned to in each case one of the sole-retaining parts 104 or to be designed as part of in each case one sole-retaining part 104. This applies, in particular, for the case where the sole-retaining parts 104 also secure the boot in the upward direction. In this case, the part 106 may, in turn, be dispensed with or divided up into two pieces, which are connected to in each case one of the sole-retaining parts 104 or constitute a piece of such a sole-retaining part 104.

It is also possible, in principle, for the sole-retaining parts 104 to be designed as fixed extensions of the guide links 103.

Provided that the sole-retaining parts 104 and 106 execute, or can execute, an upward movement by virtue of the interaction of the prism bodies 108 and 119, it is also possible for the guide links 103 to execute a corresponding upward pivoting movement around a transverse axis in the region of their eyelets at the feet 109' of the stiffening part 109.

The invention has been described with particular emphasis having been placed on the preferred embodiment thereof, but variations and modifications, within the spirit and scope of the invention, may occur to those skilled in the art to which the invention pertains.

What is claimed is:

1. A boot-retaining apparatus for a releasable ski binding for retaining the toe region of a ski boot on a ski, said apparatus comprising:

boot-retaining means for supporting an end of the ski boot against movement upwards, sideways and longitudinally of the boot, said boot-retaining means being movable counter to a restoring force reacting to forces applied to said boot-retaining means, and for releasing the boot in the sideways and upward directions when a predetermined range of elasticity is exceeded; and wherein said boot-retaining means is increasingly movable upwardly relative to an abutment means in response to the sideways movement of said boot-retaining means relative to the boot in the binding or relative to the ski; said abutment means counters upward movement of said boot-retaining means and is generally transversely immovable.

2. The boot-retaining apparatus according to claim 1 wherein said boot-retaining means has a first pressure-transmitting surface, and said abutment means has a second pressure-transimiitting surface, said first and second pressure-transmitting surfaces interacting to restrain movement of said boot-retaining means upwardly.

3. The boot-retaining apparatus according to claim 1 wherein said boot-retaining means comprise at least one first member and said abutment means comprise at least one second member, said first and second members being located by connecting members and initeracting with each other, said connecting members having slightly inclined oblique surfaces followed by steeply inclined oblique surfaces for engaging said first and second members, said boot-retaining means being movable sideways from a normal position, said boot-retaining means being initially movable upwardly by a relatively small amount relative to said abutment means when the oblique surfaces interact with one another and thereafter being upwardly movable in an increasing amount relative to said abutment means when the respective steeply inclined oblique surfaces interact with one another.

4. A boot-retaining apparatus according to claim 3, wherein said first member is at least one first prism body, said second member is at least one second prism body, said connecting member comprises two narrow strips having a neutral portion for engaging said boot-retaining means when said boot-retaining means is in a normal position, slightly inclined oblique surfaces near said respective neutral portions, and steeply inclined oblique surfaces near and on the opposite side of said slightly inclined oblique surfaces from said neutral position.

5. The boot-retaining apparatus according to claim 4, wherein said first member comprises two first prism bodies and said second member comprises two second prism bodies, said first prism bodies being arranged on said abutment means, and said second prism bodies being arranged on said boot-retaining means, said boot-retaining apparatus having a vertical center longitudinal plane and said first prism bodies and said second prism bodies being arranged symmetrically with respect to said plane.

6. The boot-retaining apparatus according to claim 4, wherein said first member comprises two first prism members and said second member comprises two second prism members, and said boot-retaining apparatus has a vertical-center longitudinal plane and further comprises a pair of boot-retaining parts arranged symmetrically with respect to said plane, and wherein said first prism bodies and said second prism bodies interact with one another, said first prism bodies being arranged on said abutment means and said second prism members being arranged on said pair of boot-retaining parts.

7. The boot-retaining apparatus according to claim 4, wherein said abutment means comprises a spring member mounted in a stationary manner remote from said spring member in the longitudinal direction between said prism body and said spring member.

8. The boot-retaining apparatus according to claim 7, and further comprises an adjustable spring abutment means operatively connected to said spring member for adjusting the length of the effective spring range of said spring member, said spring member having an end portion remote from said first prism body, said spring abutment means supporting said end portion.

9. A boot-retaining apparatus according to claim 3, wherein said first member is resiliently biased in the upward direction.

10. A boot-retaining apparatus according to claim 3, wherein said second member is resiliently biased in the upward direction.

11. The boot-retaining apparatus according to claim 1, wherein said abutment means is resiliently biased in the upward direction.

12. The boot-retaining unit as claimed in claim 6, wherein said abutment means comprises a spring member having a relatively stiff double-armed lever pivotable around a transverse axis, the boot-retaining unit, the said boot-retaining apparatus further comprising adjustable spring abutment means operatively connected to said spring member for adjusting the effective spring range of said spring member, said spring abutment means comprising an adjustable pivot-limiting means, said lever being remote from said second prism body, and the pivoting of said lever being controlled by said adjustable pivot-limiting means.

13. The boot-retaining apparatus according to claim 10, wherein said pivot-limiting means is positively coupled to said spring abutment means.

14. The boot-retaining apparatus according to claim 1, wherein said abutment means comprises a spring member.

15. The boot-retaining apparatus according to claim 7, wherein said spring member is a leaf-spring.

16. The boot-retaining apparatus according to claim 1, and wherein said boot-retaining means comprises sole-retaining means having an oblique surface sloping towards a boot to be inserted in said boot-receiving apparatus, said sole-receiving means interacting with a border of the sole of a ski boot inserted in said apparatus, and said oblique surface being engageable with the border of the sole of the boot.

17. The boot-retaining apparatus according to claim 12, wherein said boot-retaining means has oblique surfaces, said boot-retaining means being pivotable around a transverse axis for increasing the steepness of the oblique surface.

* * * * *